US005971808A

United States Patent [19]

Chiang et al.

[11] Patent Number: 5,971,808

[45] Date of Patent: Oct. 26, 1999

[54] DOUBLE-SIDED MULTI-SOCKET ADAPTER PANEL

[75] Inventors: Yi-Te Chiang, Taipei; Hui-Jen Pan, Chi-Lung, both of Taiwan

[73] Assignee: Primax Electronics Ltd., Taipei Hsien, Taiwan

[21] Appl. No.: 09/048,377

[22] Filed: Mar. 26, 1998

[30] Foreign Application Priority Data

Dec. 17, 1997 [TW] Taiwan ..... 86220960

[51] Int. Cl.[6] ..... H01R 25/00

[52] U.S. Cl. ..... 439/654

[58] Field of Search ..... 439/650, 654, 439/212, 214, 652

[56] References Cited

U.S. PATENT DOCUMENTS

| | | | |
|---|---|---|---|
| 3,353,137 | 11/1967 | Miller | 439/654 |
| 4,729,741 | 3/1988 | Peng | 439/654 |
| 4,867,701 | 9/1989 | Wiand | 439/501 |
| 4,979,907 | 12/1990 | Lee | 439/214 |
| 5,232,281 | 8/1993 | Yu . | |
| 5,272,587 | 12/1993 | Wan | 439/620 |
| 5,526,225 | 6/1996 | Wang | 439/650 |
| 5,658,158 | 8/1997 | Milan | 439/652 |

OTHER PUBLICATIONS

U.S. application No. 09/035,195, Chiang, filed Mar. 5, 1998.

*Primary Examiner*—Steven L. Stephan
*Assistant Examiner*—J. F. Duverne
*Attorney, Agent, or Firm*—Knobbe, Martens, Olson & Bear, LLP

[57] ABSTRACT

A double-sided multi-socket adapter panel whose plugging sockets alternate between two opposite sides of the adapter panel such that some of the sockets are separated further apart so that even large-size plug of a transformer adapter can be accommodated without affecting the availability of neighboring plugging sockets. The electrode-plugging slots are aligned along a straight line parallel to the general layout direction of the plugging sockets, and therefore suitable for plugging vertical plugging head. Furthermore, each plugging socket has a protective cover capable of sliding so that whenever a plugging socket is unused, the plugging slots of the socket can be shut to prevent dust from entering or any accidental touching by somebody. The conductive electrode structures are designed such that the optimal number of plugging sockets and distance of separation between two sockets are obtained. In addition, the cut-off switch of the adapter is located in a cavity at one end, with the exposed part of the switch sunken beneath the external housing. Hence, the adapter pane has a rather smooth and planar external appearance, and capable of preventing the switching on or off the adapter panel by accident.

18 Claims, 9 Drawing Sheets

DOUBLE-SIDED MULTI-SOCKET ADAPTER PANEL

CROSS-REFERENCE TO RELATED APPLICATION

This application claims the priority benefit of Taiwan application Ser. No. 86220960, filed Dec. 17, 1997, the full disclosure of which is incorporated herein by reference.

BACKGROUND OF THE INVENTION

1. Field of Invention

The present invention relates to a double-sided multi-socket adapter panel design. More particularly, the present invention relates to a double-sided multi-socket adapter panel design having a large distance of separation for some of the plugging sockets, electrode-plugging slots of the plugging sockets all aligning along a straight line, and an optimum layout for the plugging sockets.

2. Description of Related Art

Most adapter panel designs have a number of plugging sockets. There are two main types of adapters in the market nowadays. One type of adapter panel is for plugging into a power source directly in order to increase the number of plugging positions. The second type of adapter panel includes a plug and an extension cable. The former type of adapter is plugged directly into a power source socket. Due to weight and size, the maximum number of plugging positions for this type of adapter is quite limited. However, for the latter type of adapter panel, there are virtually no limits to the number of plugging sockets. Ease of management and its ability to satisfy all plug-in requirements at one time makes this type of socket very popular for plugging computer systems and its peripheral components.

Despite the extensive use of a multi-socket type of adapter panel with an extension cable, inconveniences are often found in actual applications. For example, from a user's point of view, as many sockets as possible should be packed into an adapter panel. In practice, an optimal number of sockets can be found for each adapter panel considering factors such as its volume, weight and cost. In general, the maximum number of sockets is around six.

Therefore, to increase the number of sockets for an adapter panel having a given length and a given volume, or alternatively, to reduce the amount of material used or production cost, a single-sided multi-socket adapter panel would be unsatisfactory. Consequently, the concept of a double-sided multi-socket adapter panel is initiated, for example, as in U.S. Pat. No. 5,232,381.

FIG. 1 is a split-opened perspective view of a conventional double-sided multi-socket adapter panel. Design similar to the one shown in FIG. 1 is now available in the market. As shown in FIG. 1, what makes a double-sided multi-socket adapter panel 10 possible is the innovative design of a conductive electrode bar 12. The conductive electrode bar 12 does not occupy too much space and uses very little material.

However, a number of limitations in the design make the applications of this type of double-sided multi-socket panel rather unsatisfactory. Firstly, a number of data processing products require power transformer adapter whose plugging head is especially large. Hence, when one such an adapter is plugged into a socket, its neighboring sockets are impossible to use leading to a drop in the number of actual socket positions available.

In view of this, it is preferable to have a design that can accommodate larger plugging head but without affecting the layout of plugging sockets or the material and production cost. Secondly, the respective electrode-plugging slots 16*a* and 16*b* of sockets 14 in a conventional panel are aligned into two separate rows. In other words, the sockets are arranged such that the plugging slots 16*a* are aligned as a row at the bottom while the plugging slots 16*b* are aligned as a row at the top as shown in FIG. 1.

This type of plugging socket orientation may result in some interference with neighboring sockets when a socket is plugged, and is especially serious when a large-size plug such as a power transformer adapter (most power transformer adapter has plug that is somewhat elongated in a direction parallel to the row of plugging slots 16*a* or 16*b*) is engaged. On the other hand, if a plug 20 whose cable 22 forms a 90° bent with the electrode pins 24 as shown in FIG. 2 is used, spatial occupation in a vertical direction above the socket is minimized.

However, problem such as the interference with neighboring sockets is intensified. Hence, if each socket 14 can be turned 90° from the directions of the row of plugging slots 16*a* (or 16*b*) so that a vertically oriented socket is obtained (called a vertical socket from now on), the above problem can be solved. FIG. 3 is a split-opened perspective view of a conventional vertical socket double-sided multi-socket adapter panel.

The conductive electrode bar 32 is a structure that consumes a little more material, but somehow able to align the electrode-plugging slots 36*a* and 36*b* of sockets 34 in a row so that all the sockets form a 90° angle with the plug-in position of the aforementioned socket 14 as shown in FIG. 1. Yet, the double-sided multi-socket adapter panel shown in FIG. 3 is still not an optimal system. If the conductive electrode bar 32 of FIG. 3 is used as a basis for forming double-sided multi-socket adapter panel, more material is needed or distance between sockets has to be shortened compared with the conductive electrode bar 12 design of FIG. 1. Therefore, a greater cost of production is incurred.

Furthermore, as shown in FIG. 1, the on/off switch 18 of the adapter panel 10 is fixed in a position on one side of the plugging sockets 14. Because most commonly used on/off switch in the market has a fixed height, that part of the panel for enclosing the switch must be made thicker. This makes it difficult to flatten the panel further and will lead to a non-uniform outward appearance. Hence, it is much preferable to reposition the switch. In addition, no protective covers are put on top of each plugging socket. Therefore, when a particular socket is unused, the plugging slots are exposed. Consequently, dust may enter the slot or someone may accidentally touch the live part of the electrode causing electrocution.

In light of the foregoing, there is a need to provide an optimal design for a double-sided multi-socket adapter panel.

SUMMARY OF THE INVENTION

Accordingly, the present invention is to provide a double-sided multi-socket adapter panel not only suitable for accommodating a large-size plug such as a transformer adapter without interfering with other plugging positions, but the plugging slots for electrodes are also aligned in a row so that plugs can be plugged into the sockets in a vertical direction. Moreover, the design of the adapter panel is such that the optimal number of plugging sockets and suitable separation between sockets are obtained.

In addition, the cut-off switch is installed inside a cavity in the housing located at one end of the panel where no plugging sockets are placed, and so the adapter panel has a flat and uniform appearance. Furthermore, the exposed part of the cutoff switch for switching is housed within a sunken groove in the housing, and hence able to prevent accidental touching of the switch thereby turning the power of the adapter panel on or off prematurely.

In another aspect of this invention, a double-sided multi-socket adapter panel is provided where there is a protective cover on top of each plugging socket. When any plugging socket is unused, it can be covered manually to exclude dust from the sockets and to prevent accidental touching by somebody.

To achieve these and other advantages and in accordance with the purpose of the invention, as embodied and broadly described herein, the invention provides a double-sided multi-socket adapter panel. The adapter panel comprises a housing having a rectangular and smooth external appearance. The housing is assembled from two half-panels. Each half-panel has a plurality of plugging sockets, and each socket contains two plugging slots for electrodes and one plugging slot for earth connection.

Each pair of electrode-plugging slots of a plugging socket is aligned along the same straight line and is parallel to the general direction of layout for the plugging sockets. There is a protective cover on top of each plugging socket. The protective cover is able to slide over the plugging socket. If a particular plugging socket is unused, the cover can be moved manually to block the electrode-plugging slots and the earth-plugging slot, thereby preventing any dust intrusion or accidental touching by somebody.

Two conductive electrode bars are fixed inside the housing. Each conductive electrode bar includes a plurality of electrode tooth-plates such that there is one tooth-plate in each electrode-plugging slot for every plugging socket. One earth conductive bar having connection with the earth-plugging slot for every plugging socket is also fixed inside the housing. A cutoff switch is installed at one end embedded inside a cavity within the housing, with the exposed switch sunken into a groove in the housing. The cutoff switch includes an automatic cut-off function, which automatically cut off power supply when an abnormal load is sensed.

The adapter panel also includes an extension cable with a plug at one end for connecting with the two conductive electrode bars, the earth conductive bar and the cut-off switch and supplying the necessary power. Furthermore, the adapter panel is designed such that one side of the panel has four ordinarily spaced plugging sockets. On the opposite side of the adapter panel, inserted in vacant positions in the middle and on two sides of the four plugging sockets, are three wider spaced plugging sockets. These three plugging sockets are especially suitable for plugging exceptionally large plugs such as a transformer adapter.

It is to be understood that both the foregoing general description and the following detailed description are exemplary, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE PREFERRED EMBODIMENTS

Figure 1:
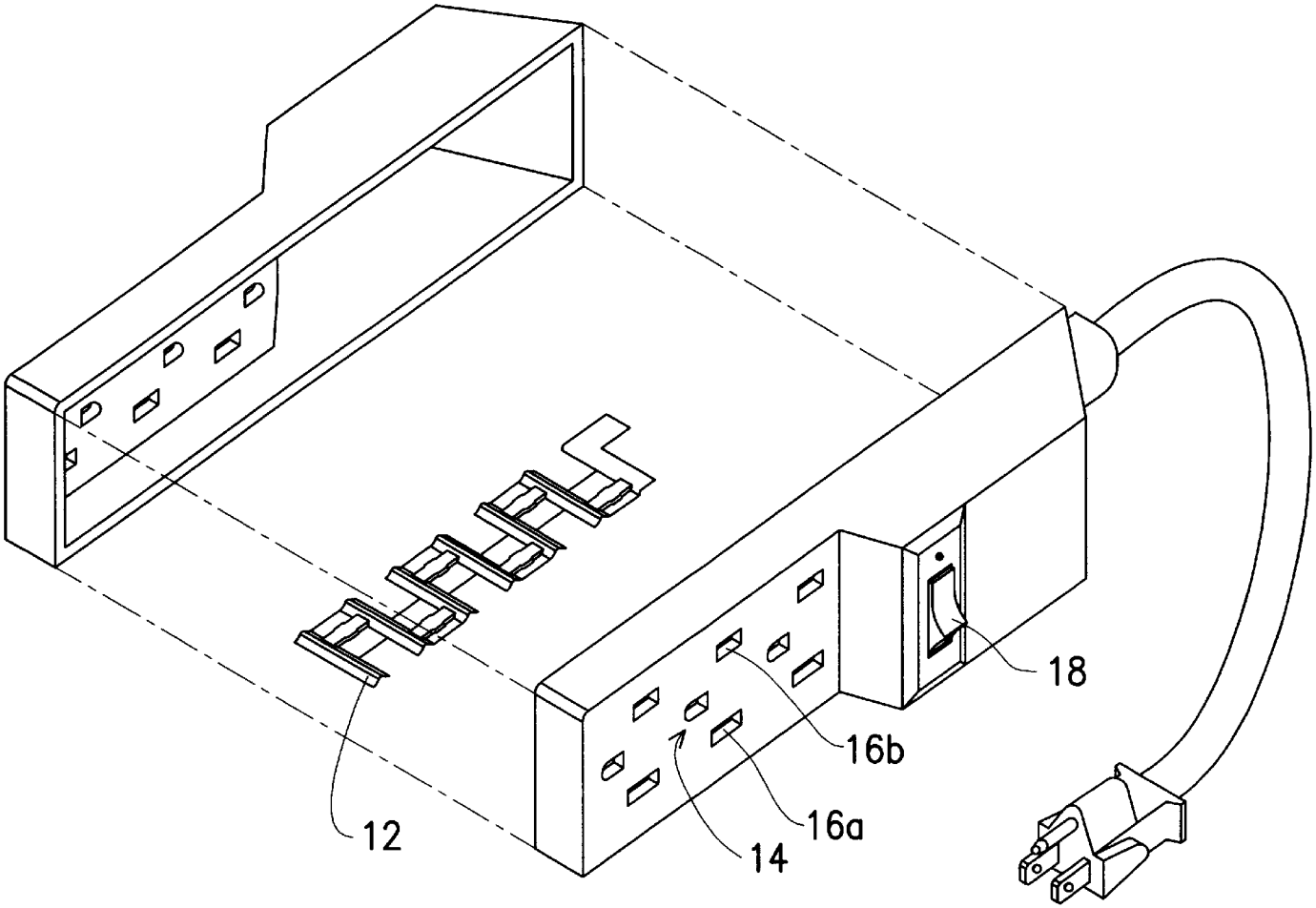
FIG. 1 (PRIOR ART)
FIG. 1 is a split-opened perspective view of a conventional double-sided multi-socket adapter panel.

Reference will now be made in detail to the present preferred embodiments of the invention, examples of which are illustrated in the accompanying drawings. Wherever possible, the same reference numbers are used in the drawings and the description to refer to the same or like parts.

Figure 4:
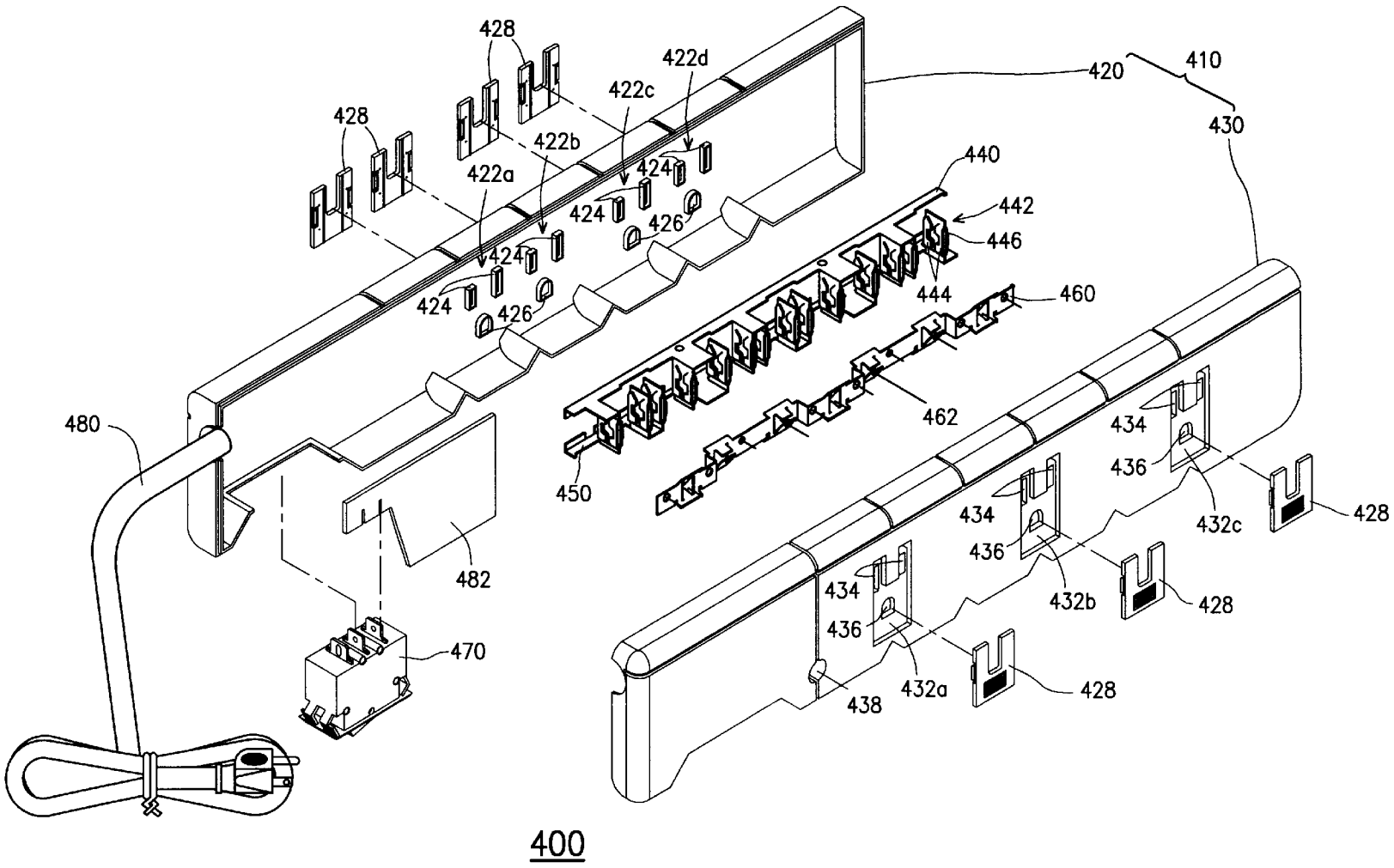
FIG. 4 is an explosive view showing all the components of a double-sided multi-socket adapter panel according to the preferred embodiment of this invention.

FIG. 4 is an explosive view showing all the components of a double-sided multi-socket adapter panel according to the preferred embodiment of this invention. The adapter panel 400 comprises a housing 410, two conductive electrode bars 440 and 450, an earth conductive bar 460, a cut-off switch 470 and an extension cable having a plug at one end 480.

The housing 410 is assembled from two half-panels 420 and 430 to form a smooth rectangular compartment. On the surface of the half-panels 420, there are four plugging sockets 422*a* to 422*d* each comprising two electrode-plugging slots 424 and an earth-plugging slot 426. In addition, the two electrode-plugging slots 424 and the earth-plugging slot 426 of the plugging sockets 422*a* to 422*d* are aligned in a straight line parallel to the general layout direction of the plugging sockets 422*a* to 422*d*. Hence, even when all the plugging sockets 422*a* to 422*d* are plugged, since all the plugs are in parallel to each other, there will be no interference between plugging cables of neighboring plugging sockets.

Figure 2:
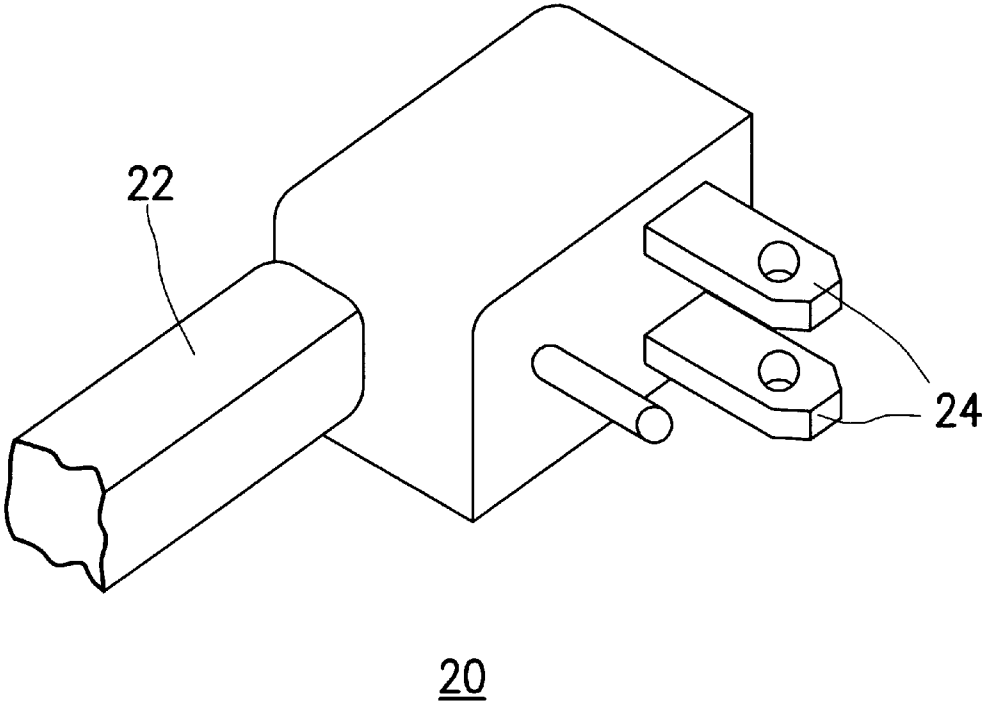
FIG. 2 (PRIOR ART)
FIG. 2 is the perspective view of a plug whose cable forms a 90° bent with the electrode pins.
Figure 3:
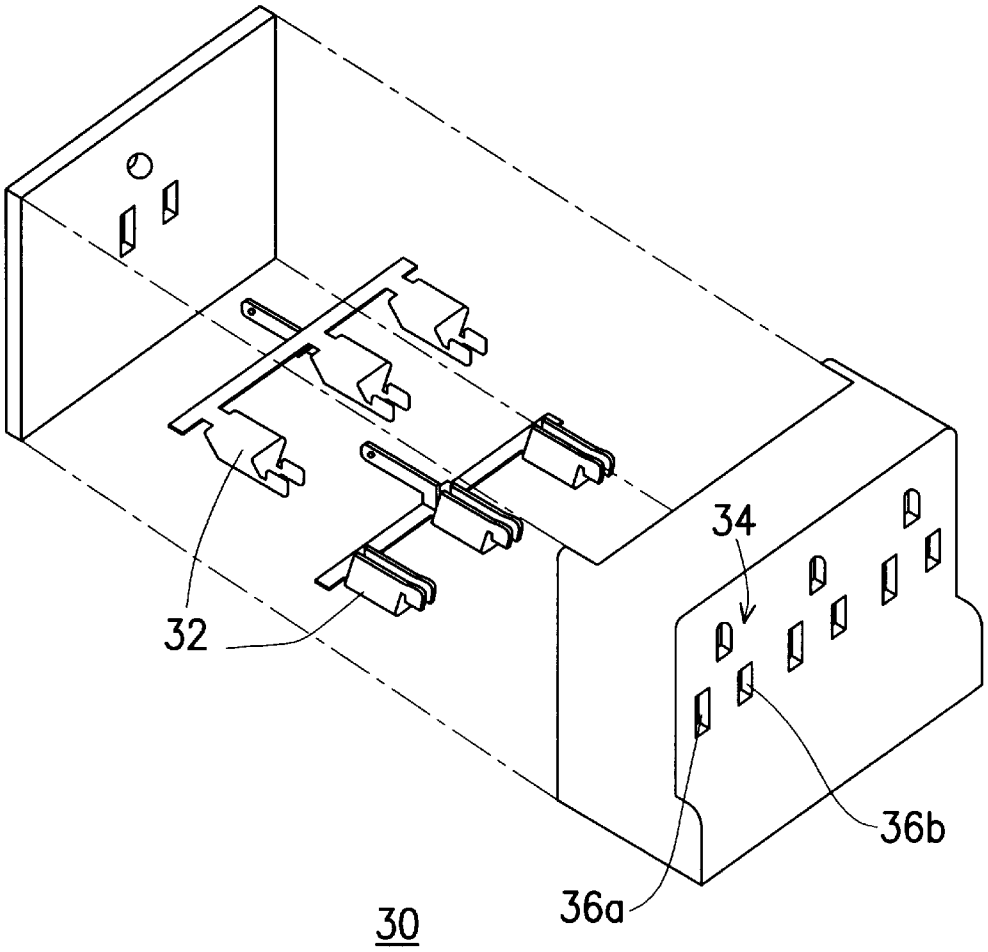
FIG. 3 (PRIOR ART)
FIG. 3 is a split-opened perspective view of a conventional vertical socket double-sided multi-socket adapter panel.

The advantages are more obvious when a plug such as the one shown in FIG. 2 is used. Distance of separation between each of the plugging sockets 422*a* to 422*d* are comparable to the plugging socket 34 as shown in FIG. 3, and are applicable for general plug-in situation. The distance of separation between plugging sockets 422*b* and 422*c* is slightly larger, and hence able to accommodate a plugging socket 432*b* for the other side of the panel.

In addition, regions outside the plugging sockets 422*a* and 422*d* are unoccupied, therefore, another two plugging sockets 432*a* and 432*c* for the other side of the panel can be accommodated. Consequently, each of the three plugging sockets 432*a* to 432*c* are widely separated from each other, and thus can be used for plugging exceptionally large plugs such as a transformer adapter. Similarly, the two electrode-plugging slots 434 and the earth-plugging slot 436 of each plugging sockets 432*a* to 432*c* are aligned in a straight line parallel to the general layout direction of the plugging sockets 432*a* to 432*c*.

Figure 8B:
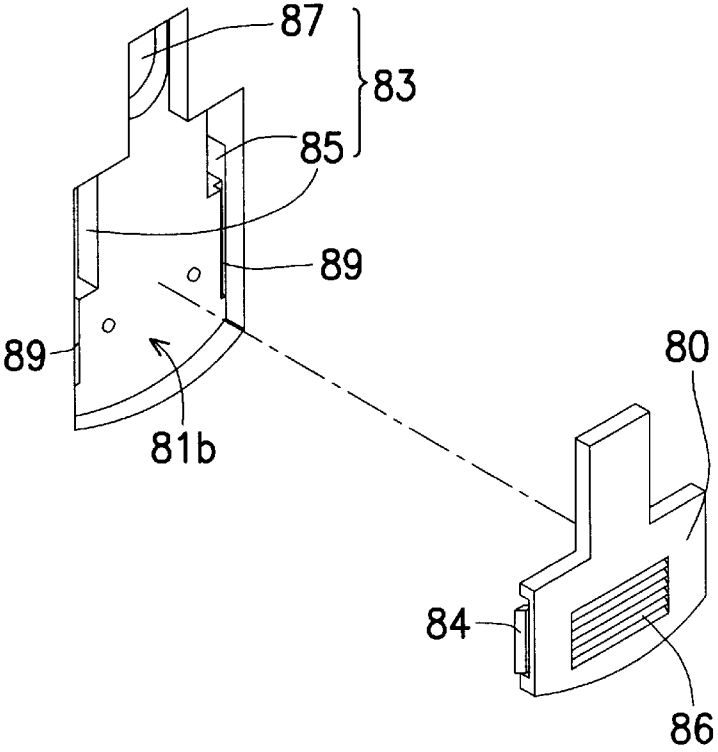
FIG. 8*a* and FIG. 8*b* show two types of protective cover designs for covering the plugging slots of each plugging socket.
Figure 8A:
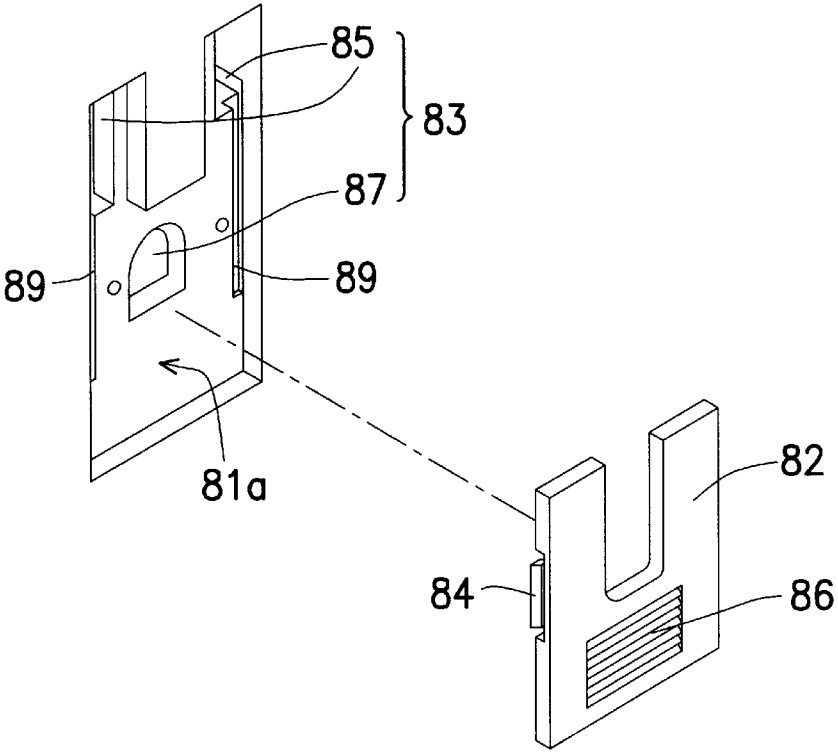

Furthermore, there is a protective cover 428 above each of the plugging sockets 422*a* to 422*d* and 432*a* to 432*c*. The protective cover 428 snapped-in to the grooves on each side of a plugging cavity is able to slide so that any one of the unused plugging sockets 422*a* to 422*d* and 432*a* to 432*c* can be shut. The cover is able to cover the two electrode-plugging slots and the earth-plugging slots of each plugging socket completely, thereby preventing dust from entering the socket as well as accidental touching of the live terminals by somebody. FIG. 8*a* and FIG. 8*b* show two types of protective cover designs for covering the plugging slots of each plugging socket.

FIG. 8*a* shows one type of protective cover assembly that is suitable for the plugging sockets of an adapter panel. In FIG. 8*a*, only the plugging cavity 81*a* and a protective cover 82 are drawn. Inside the plugging cavity 81*a* includes a group of plugging slots 83, for example, two electrode-plugging slots 85 or an additional earth-plugging slot 87. On each side of the plugging cavity 81*a* in a direction perpendicular to the line formed by the two electrode-plugging slots 85 is a sliding groove 89. The protective cover 82 is flush-mounted into the plugging cavity 81*a* so that a smooth surface is obtained at their junction interface.

Furthermore, each side of the cover 82 has a guiding pin 84 that grips onto the interior of the sliding groove 89. Hence, the cover 82 is free to move along the sliding groove 89. In addition, there is a roughened patch 86 on the upper surface of the cover 82 to facilitate manual pushing of the cover. Therefore, when a group of plugging slots 83 is unused, the two electrode-plugging slots 85 and the earth-plugging slot 87 can be covered simultaneously.

FIG. 8*b* shows a second type of protective cover assembly that is suitable for the plugging sockets of an adapter panel. In FIG. 8*b*, only the plugging cavity 81*b* and a protective cover 80 are drawn. Since the second type of protective cover assembly is almost the same as in the first type, the same labels are used for most components. The two types of protective covers differ mainly in the shape of the cover, shape of the plugging cavity and orientation of the plugging socket. For the first type of protective cover assembly, extra space must be allowed below the earth-plugging slot 87 for the cover 82 to slide down and expose the socket.

On the other hand, in the second type of protective cover assembly, extra space must be allowed below the two electrode-plugging slots 85 for the cover 80 to slide down and expose the socket. Therefore, the two types of protective cover designs can be selected alternatively depending on particular spatial requirements.

Figure 5A:
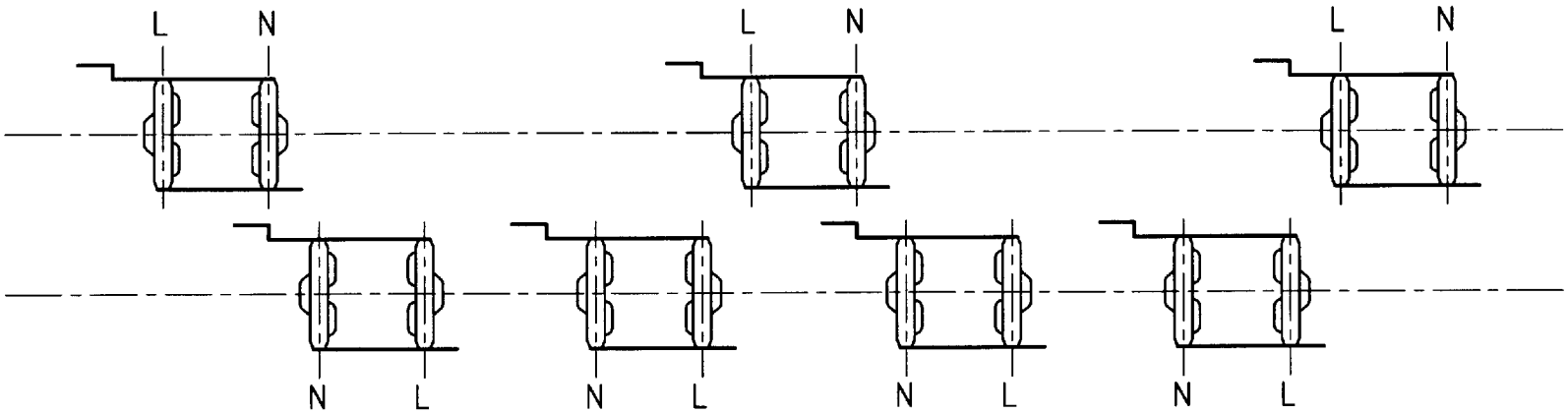
FIGS. 5*a* through 5*c* are schematic views showing the design flow of the conductive electrode bar in FIG. 4 according to the embodiment of this invention.
Figure 5B:
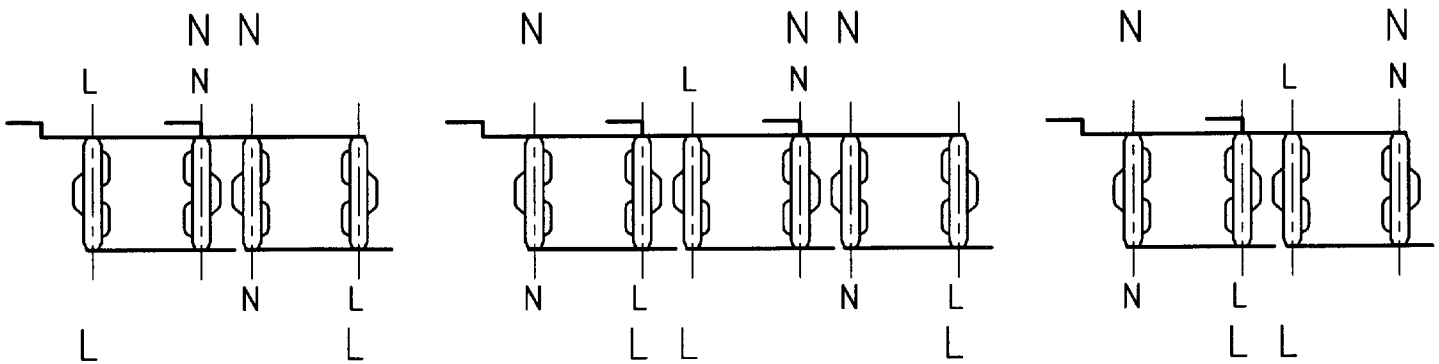
Figure 5C:
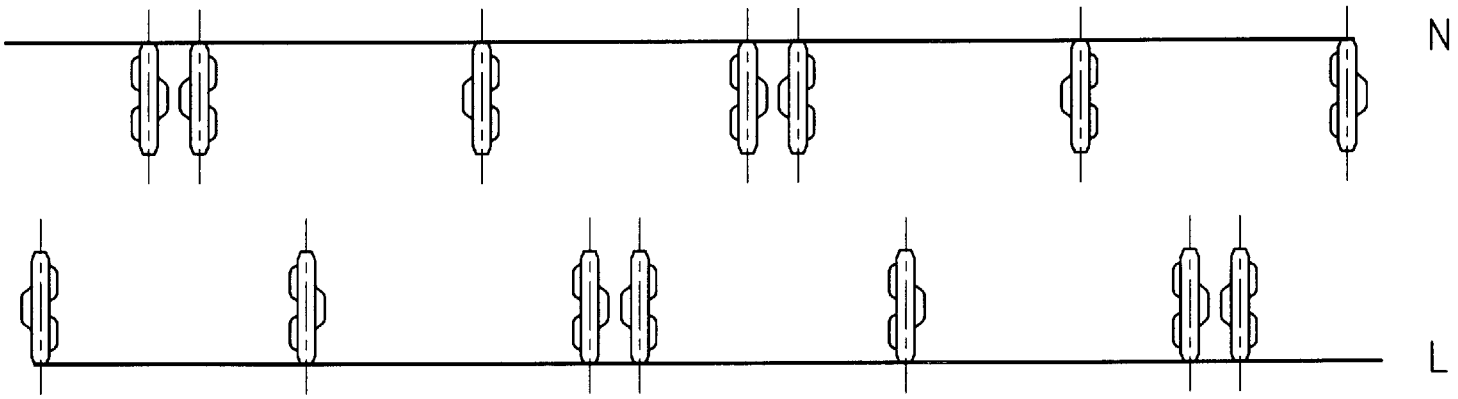

The conductive electrode bar 440 and 450 is fixed inside the housing 410. In general, they are made from copper material. FIGS. 5*a* through 5*c* are schematic views showing the design flow of the conductive electrode bar in FIG. 4 according to the embodiment of this invention. FIG. 5*a* shows the distribution of the four plugging sockets 422*a* to 422*d* on the half-panel 420 as well as the three sockets 432*a* to 432*c* on the half-panel 430 as shown in FIG. 4.

The polarity of the plugging slots are carefully distinguished (labeled L for live and N for neutral). In FIG. 5*b*, all seven plugging sockets are aligned together to plan the layout of the electrode-plugging slots in a double-sided multi-socket adapter panel. In FIG. 5*c*, electrode-plugging slots having different polarity are separated into two groups, one for live connection and one for neutral connection, thereby forming a layout for fabricating the conductive electrode bars 440 and 450 respectively. Each of the conductive electrode bars 440 and 450 is then fabricated such that there is a contacting part to correspond to each electrode-plugging slot of each plugging socket.

For example, the design here can use a similar design concept as in the design of a conductive electrode bar 12 as described in FIG. 1. The conductive electrode bars 440 and 450 comprise a plurality of electrode tooth-plates 442 distributed such that each electrode-plugging slot 424 and 434 of every socket 422*a* to 422*d* and 432*a* to 432*c* contains one electrode tooth-plate 442. Each electrode tooth-plate 442 has two side strips 444 and a central bulging section 446 enclosing a hollow, and that a plugging pin of a plug (not drawn) can fit perfectly inside the central hollow for proper electrical contact.

The earth conductive bar 460 is also fixed inside the housing 410, and is generally made from copper. Design of the earth conductive bar 460 is structurally quite simple. In fact, any structure that can provide a caved-in guiding hole 462 in each position that corresponds to the earth-plugging slots 426 and 436 of the plugging sockets 422*a* to 422*d* and 432*a* to 432*c* is feasible. Obviously, if no earth connections for the plugging sockets are required, the earth conductive bar 460 in unnecessary.

The cut-off switch 470 is located at one end inside the housing 410 avoiding positions where the plugging sockets 422*a* to 422*d* and 432*a* to 432*c* are occupied. Furthermore, the exposed part of the switch is sunken inside a cavity at a level below the external housing. Therefore, height of the cut-off switch 470 will not affect the uniform outward appearance of the housing 410, and the switch will not be switched on or off accidentally. The cut-off switch 470 can be a switch that includes an automatic power cut-off function, for example.

Therefore, when abnormal loading is sensed, power supply will be cut automatically. The cut-off switch 470 can also include a power indicator light that shows the on/off state of the adapter panel 400. However, whether an indicator light is present on the cut-off switch 470 or not, an extra impulse protection indicator light 438 can be form on the surface of the half-panel 430.

The other end of the extension cable 480 is connected to a circuit board 482 having circuits in it (not drawn). The circuit board 482 links up the two conductive electrode bars 440 and 450, the earth conductive bar 460 and the cut-off switch 470, and supplies the necessary electric power to the adapter panel 400.

Figure 6:
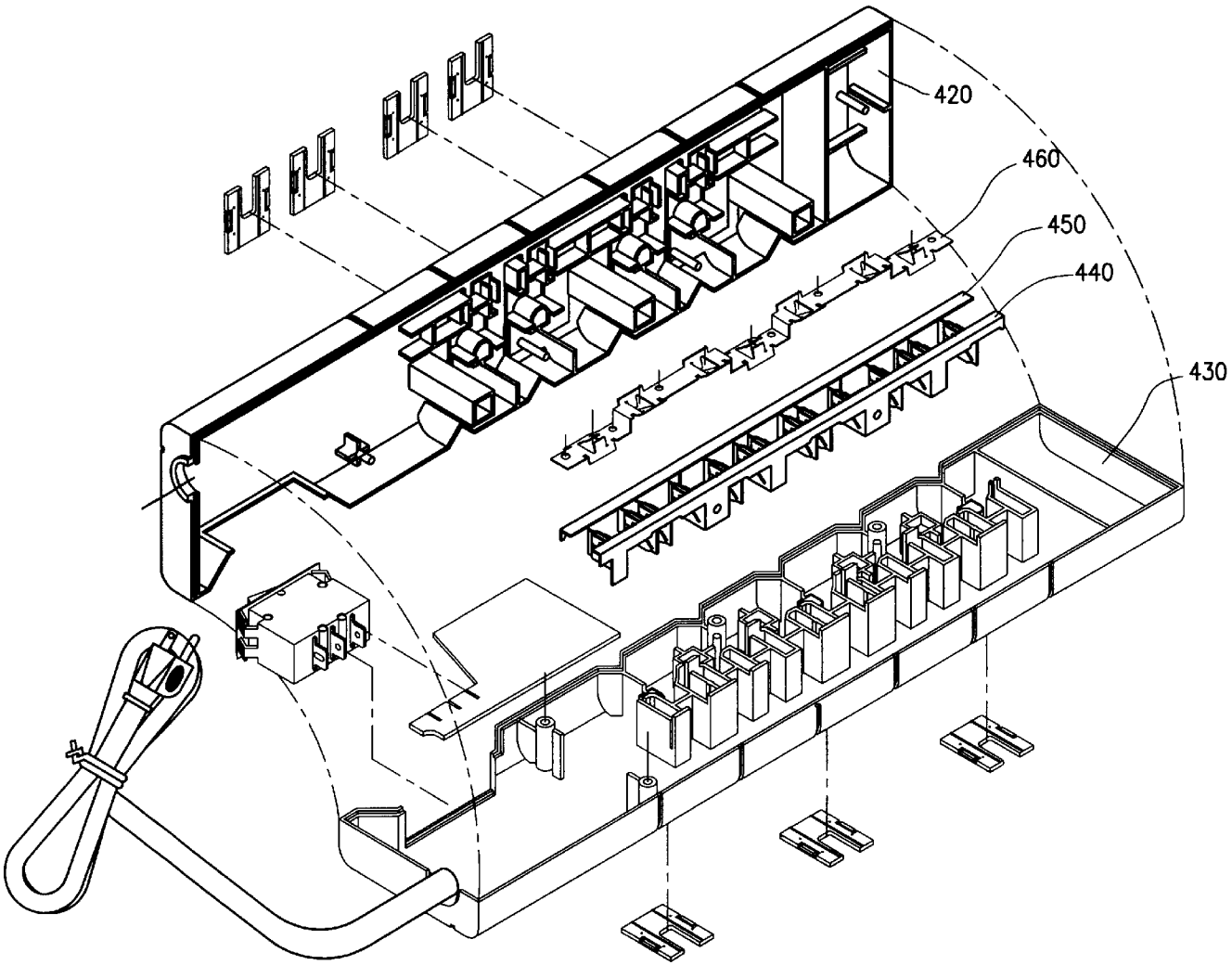
FIG. 6 is a detailed perspective view showing two half-panels of the adapter panel housing split-opened to see the internal structures for holding the conductive electrode bars and the earth conductive bar.
Figure 7:
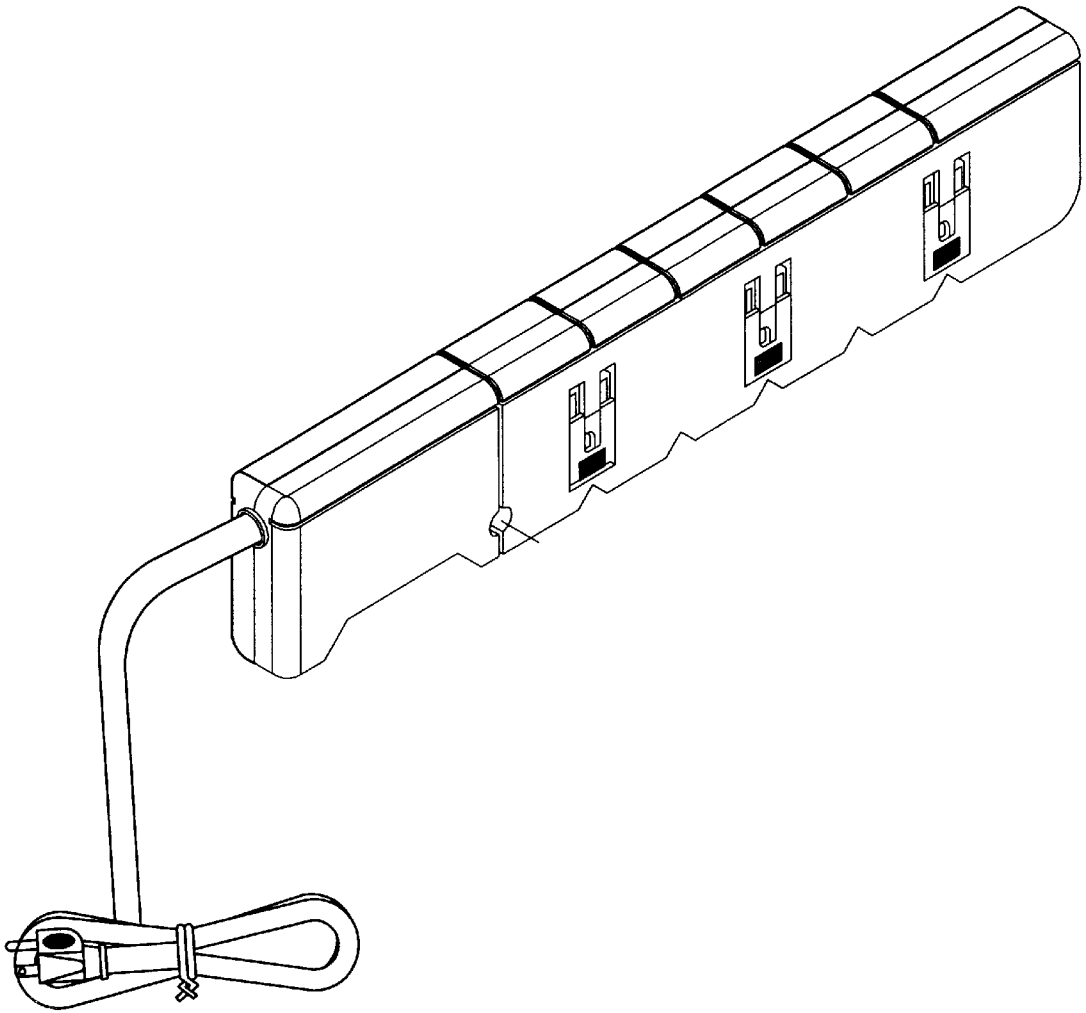
FIG. 7 is a perspective view showing the assembled double-sided multi-socket adapter panel according to this invention.

FIG. 6 is a detailed perspective view of FIG. 4 showing two half-panels of the adapter panel housing split-opened to see the internal structures for holding the conductive electrode bars and the earth conductive bar. Utilizing the intricate grids inside the half-panels 420 and 430 formed by an injection molding process, the conductive electrode bars 440 and 450 as well as the earth conductive bar 460 can be securely fixed inside the housing 410. After proper assembling procedures, a double-sided multi-socket adapter panel as shown in FIG. 7 is obtained.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A double-sided multi-socket adapter panel comprising:

a housing assembled from two opposing half-panels with each half-panel having a plurality of plugging sockets, each of the plugging sockets having two electrode-plugging slots and an earth-plugging slot, and all electrode-plugging slots of each half-panel being aligned along a straight line and all the earth-plugging slots of each half-panel are also aligned along that straight line, wherein the plugging sockets alternate on each opposing half-panel such that some of the plugging sockets are spaced further apart so that even larger plugs can be accommodated without interfering with the use of neighboring sockets;

two conductive electrode bars fixed inside the housing with each conductive electrode bar having a plurality of contacting parts that correspond to the electrode-plugging slots of each plugging socket;

a cutoff switch installed at one end of the housing where no sockets are located, and an extension cable having a plug connected with the two conductive electrode bars, an earth conductive bar and the cutoff switch for providing power to the adapter panel.

2. The adapter panel of claim 1, wherein each plugging socket has a protective cover that can slide up or down for covering the plugging slots of unused plugging sockets such that the intrusion of dust and accidental touching are prevented.

3. The adapter panel of claim 1, wherein one of the half-panels contains an impulse protection indicator light.

4. The adapter panel of claim 1, wherein the housing runs longitudinally, having a rectangular cross-section and a planar external shape.

5. The adapter panel of claim 1, wherein one of the half-panels contains four moderately spaced plugging sockets for general use comprising first, second, third and fourth sequentially located plugging sockets with the first and second sockets and third and fourth plugging sockets being spaced a first distance apart and with the second and third sockets being spaced a second distance apart which second distance is greater than the first distance, the one side of the half-panel further containing ends adjacent to but spaced apart from the first and fourth sockets to form vacant end spaces, and wherein the other half-panel contains fifth, sixth and seventh sequentially located plugging sockets suitable for use even for plugging in a transformer adapter, the fifth and seventh sockets being located opposite the vacant spaces and the sixth socket being located opposite a space formed by the second distance.

6. The adapter panel of claim 1, wherein the conductive contacting parts include a plurality of neutral and live electrode tooth-plates distributed such that each electrode-plugging slot position has an electrode tooth-plate.

7. The adapter panel of claim 6, wherein the electrode tooth-plate is a structure having two side edges and a central bulging sections with a hollow in the middle capable of fitting a plugging pin of a plug inside, and is formed by a punching operation.

8. The adapter panel of claim 1, wherein the two conductive electrode bars are made from copper.

9. The adapter panel of claim 1, wherein the cut-off switch further includes a power indicator light to display an on/off working status of the adapter panel.

10. The adapter panel of claim 1, wherein the cut-off switch further includes an automatic cut-off function so that when the loading is abnormal, power supply will be cut automatically.

11. The adapter panel of claim 1, wherein the panel further includes an earth conductive bar fixed inside the housing with a caved-in guiding hole in each position that matches to the earth-plugging slots of the plugging sockets.

12. A double-sided multi-socket adapter panel comprising:

a housing assembled from two opposing half-panels and forming a smooth rectangular external shape, each half-panel having a plurality of plugging sockets each having two electrode-plugging slots and one earth-plugging slot, the plugging sockets alternating between each side of the adapter panel such that the plugging sockets on one half-panel are spaced further apart and capable of plugging in even a transformer adapter plug without interfering with the use of neighboring sockets, in addition, all the electrode-plugging slots on each half-panel are aligned along a single straight line, furthermore, a protective cover capable of sliding in a direction perpendicular to the line formed by the electrode-plugging slots is placed above each plugging socket, hence, the electrode-plugging slots and earth-plugging slot of any unused plugging socket can be shut;

two conductive electrode bars fixed inside the housing, comprising a plurality of electrode tooth-plates, the tooth-plates being positioned such that there is one inside each electrode-plugging slot of every plugging socket;

an earth conductive bar fixed inside the housing with a caved-in guiding hole in each position that corresponds to the earth-plugging slots of the plugging sockets;

a cutoff switch installed at one end of the housing where no sockets are located, and includes an automatic cut-off function, which cuts off the power supply when an abnormal loading is sensed; and an extension cable having a plug connected with the two conductive electrode bars, the earth conductive bar and the cutoff switch for providing power to the adapter panel.

13. The adapter panel of claim 12, wherein one of the half-panels contains an impulse protection indicator light.

14. The adapter panel of claim 12, wherein one of the half-panels contains four moderately spaced plugging sockets for general use and separated by equal spaces except for the middle two sockets which are separated by a larger, vacant space, the one side panel having ends separated from the adjacent sockets to form vacant end spaces, and on the opposite half-panel, inserted opposite the vacant space and the vacant end spaces, are three widely spaced plugging sockets suitable even for plugging a transformer adapter.

15. The adapter panel of claim 12, wherein the electrode tooth-plate is a structure having two side edges and a central bulging sections with a hollow in the middle capable of fitting a plugging pin of a plug inside, and is formed by a punching operation.

16. The adapter panel of claim 12, wherein the two conductive electrode bars are made from copper.

17. The adapter panel of claim 12, wherein the cut-off switch further includes a power indicator light to display an on/off working status of the adapter panel.

18. A double-sided multi-socket adapter panel comprising:

a housing assembly having opposing first and second sides with each side having a plurality of plugging sockets in alternating locations, the sockets on the first side having pairs of sockets spaced a distance X apart with a larger distance separating at least one adjacent pair of sockets, the first side having end spaces between ends of the first side and the adjacent sockets on the first side, the second side having its sockets spaced a distance Y apart where the distance Y is greater than the distance X, the sockets on the second side being located opposite the end spaces on the first side and opposite the larger distance separating the adjacent pair of sockets on the first side, the sockets each having two electrode-plugging slots and one earth-plugging slot with the electrode-plugging slots being arranged along the same straight line;

two conductive electrode bars fixed inside the housing with each conductive electrode bar having a plurality of contacting parts that are in electrical communication with the electrode-plugging slots;

a conductive earth-electrode bar in electrical communication with the earth-plugging slots;

an extension cable having a plug connected with the electrode bars and the earth-conductive bar to provide power to the sockets.

* * * * *